US010593465B2

(12) United States Patent
Ha et al.

(10) Patent No.: US 10,593,465 B2
(45) Date of Patent: Mar. 17, 2020

(54) MULTILAYER CHIP BEAD

(71) Applicant: SAMSUNG ELECTRO-MECHANICS CO., LTD., Suwon-si, Gyeonggi-do (KR)

(72) Inventors: Young Jin Ha, Suwon-si (KR); Hyun Ju Jung, Suwon-si (KR); Jeong Hwan Im, Suwon-si (KR); So Young Jun, Suwon-si (KR); Sung Jin Park, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 38 days.

(21) Appl. No.: 15/708,947

(22) Filed: Sep. 19, 2017

(65) Prior Publication Data

US 2018/0308617 A1 Oct. 25, 2018

(30) Foreign Application Priority Data

Apr. 19, 2017 (KR) ..... 10-2017-0050607

(51) Int. Cl.
*H01F 5/00* (2006.01)
*H01F 27/28* (2006.01)
(Continued)

(52) U.S. Cl.
CPC ..... *H01F 27/2804* (2013.01); *H01F 1/147* (2013.01); *H01F 17/0013* (2013.01); *H01F 27/24* (2013.01); *H01F 27/292* (2013.01); *H01F 27/34* (2013.01); *H01F 1/344* (2013.01); *H01F 27/255* (2013.01); *H01F 2027/2809* (2013.01)

(58) Field of Classification Search
USPC ..... 336/200
See application file for complete search history.

(56) References Cited

U.S. PATENT DOCUMENTS 9,812,257 B2 * 11/2017 Itoh ..... H01F 17/0013
2003/0098496 A1 5/2003 Sugiyama et al.
(Continued)

FOREIGN PATENT DOCUMENTS

CN 202712271 U 1/2013
CN 104733153 A 6/2015
(Continued)

OTHER PUBLICATIONS

Korean Office Action issued in corresponding Korean Patent Application No. 10-2017-0050607, dated May 1, 2018, with English Translation.
(Continued)

*Primary Examiner* — Ronald Hinson
(74) *Attorney, Agent, or Firm* — Morgan, Lewis & Bockius LLP

(57) ABSTRACT

A multilayer chip bead includes: a body including a coil portion and cover layers disposed on upper and lower surfaces of the coil portion; first and second external electrodes disposed on external surfaces of the body; and a coil disposed in the coil portion, including coil patterns having a spiral shape and lead patterns, and having both end portions connected to the first and second external electrodes, respectively, through the lead patterns. A width of the lead pattern is smaller than that of the coil pattern.

7 Claims, 8 Drawing Sheets

(51) Int. Cl.

| | |
|---|---|
| ***H01F 27/29*** | (2006.01) |
| ***H01F 1/147*** | (2006.01) |
| ***H01F 27/24*** | (2006.01) |
| ***H01F 17/00*** | (2006.01) |
| ***H01F 27/34*** | (2006.01) |
| *H01F 27/255* | (2006.01) |
| *H01F 1/34* | (2006.01) |

(56) References Cited

U.S. PATENT DOCUMENTS

| | | | | |
|---|---|---|---|---|
| 2013/0200980 | A1 | 8/2013 | Yokoyama et al. | |
| 2016/0351319 | A1 | 12/2016 | Jeong | |
| 2017/0011838 | A1* | 1/2017 | Asada | H01F 17/0013 |
| 2017/0025220 | A1* | 1/2017 | Nakaniwa | H01F 27/245 |

FOREIGN PATENT DOCUMENTS

| | | | |
|---|---|---|---|
| JP | 2002-064016 | A | 2/2002 |
| JP | 2010-287722 | A | 12/2010 |
| JP | 5451791 | B2 | 3/2014 |
| KR | 10-2003-0043645 | A | 6/2003 |
| KR | 10-2015-0033343 | A | 4/2015 |
| KR | 10-2016-0057785 | A | 5/2016 |
| KR | 10-2016-0139968 | A | 12/2016 |

OTHER PUBLICATIONS

Office Action issued in corresponding Chinese Patent Application No. 201711095812.9 dated Nov. 5, 2019, with English translation.

* cited by examiner

MULTILAYER CHIP BEAD

CROSS-REFERENCE TO RELATED APPLICATION(S)

This application claims benefit of priority to Korean Patent Application No. 10-2017-0050607 filed on Apr. 19, 2017 in the Korean Intellectual Property Office, the disclosure of which is incorporated herein by reference in its entirety.

TECHNICAL FIELD

The present disclosure relates to a multilayer chip bead.

BACKGROUND

Recently, in accordance with increases in the speed of digital devices such as mobile phones, and the like, the necessity of raising a frequency band of components mounted in the digital devices has increased, and a demand for raising a frequency band of a multilayer chip bead, a noise countermeasure component, has also increased.

Recently, demand has increased to the GHz band, and high impedance has been required in a high frequency band of several GHz.

In order for the multilayer chip bead to have good high frequency characteristics, it is important to reduce stray capacitance generated between an external electrode and a coil electrode of the multilayer chip bead.

In order to suppress such stray capacitance of the multilayer chip bead, a coil is generally disposed perpendicularly to a mounting surface. However, in a case in which the coil is disposed perpendicularly to the mounting surface, the number of stacked layers is increased in order to secure performance of the multilayer chip bead, a high degree of precision is required in a dicing process, and strength of a product is reduced.

SUMMARY

An aspect of the present disclosure may provide a multilayer chip bead in which a self-resonant frequency (SRF) may be increased by reducing stray capacitance between a lead pattern and a coil pattern while maintaining Rdc.

According to an aspect of the present disclosure, a multilayer chip bead may include: a body including a coil portion and cover layers disposed on upper and lower surfaces of the coil portion; first and second external electrodes disposed on external surfaces of the body; and a coil disposed in the coil portion, including coil patterns having a spiral shape and lead patterns, and having both end portions connected to the first and second external electrodes, respectively, through the lead patterns. A width of the lead pattern is smaller than that of the coil pattern.

According to another aspect of the present disclosure, a multilayer chip bead may include: a body including a coil portion and cover layers disposed on upper and lower surfaces of the coil portion; first and second external electrodes disposed on external surfaces of the body; a first coil disposed in the coil portion, including first coil patterns having a spiral shape and first lead patterns, and having both end portions connected to the first and second external electrodes, respectively, through the first lead patterns; and a second coil disposed in the coil portion, including second coil patterns having a spiral shape and second lead patterns, and having both end portions connected to the first and second external electrodes, respectively, through the second lead patterns. A width of each of the first and second lead patterns is smaller than that of the coil pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
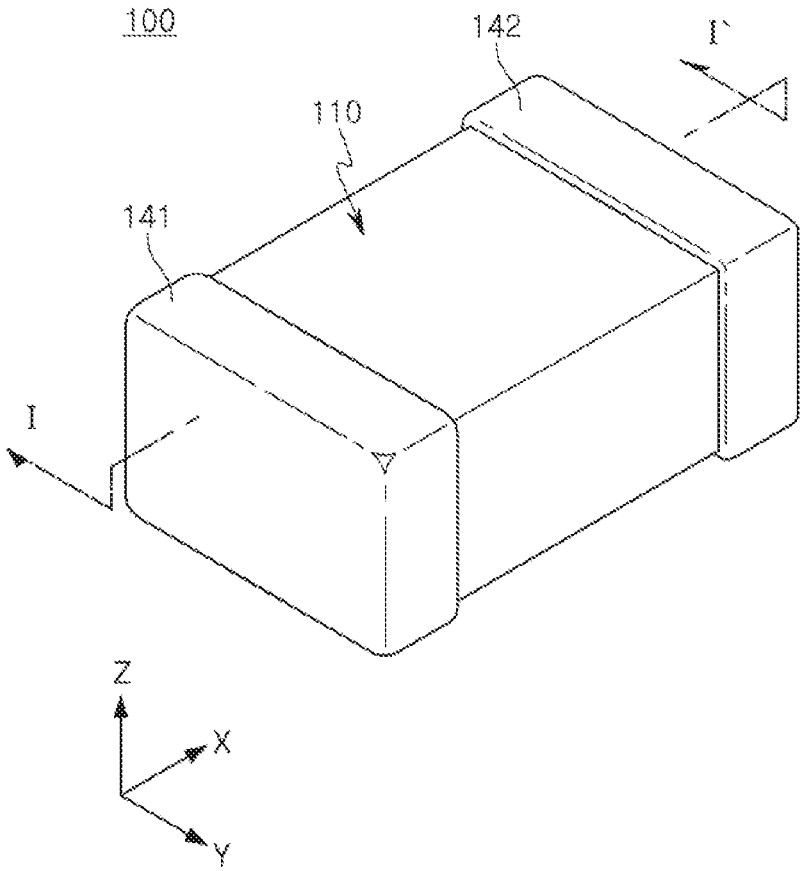
FIG. 1 is a schematic perspective view illustrating a multilayer chip bead according to an exemplary embodiment in the present disclosure.

Hereinafter, exemplary embodiments of the present disclosure will now be described in detail with reference to the accompanying drawings. One of ordinary skill in the art should appreciate that the number of coil patterns illustrated in the drawings is merely for illustration purpose and the present disclosure should not be limited thereto. For example, the number of coil patterns may be greater or less than that is illustrated in the drawings.

Figure 2:
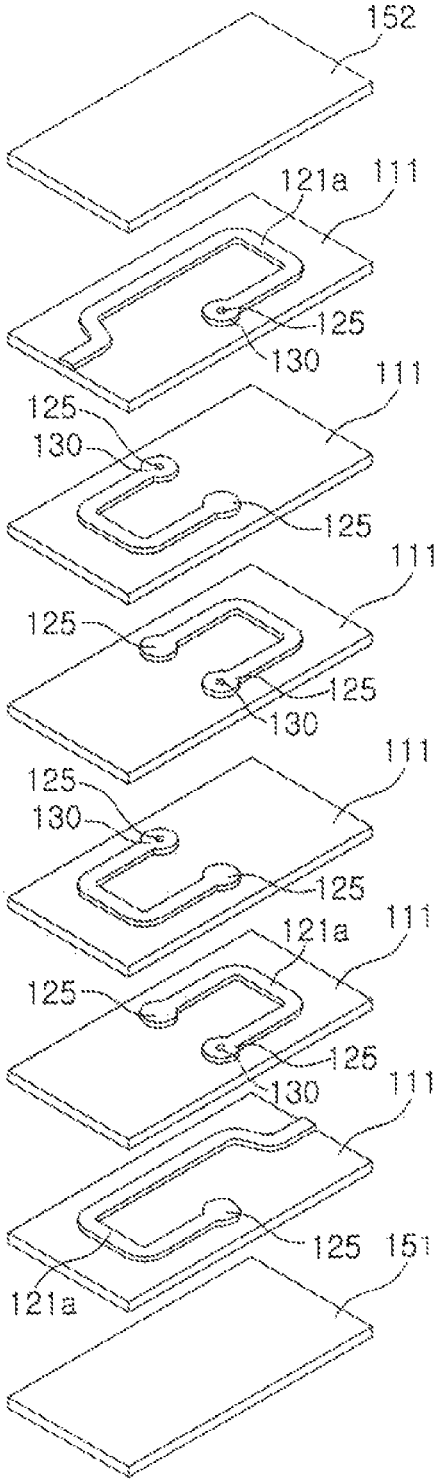
FIG. 2 is a schematic exploded perspective view illustrating the multilayer chip bead according to an exemplary embodiment in the present disclosure.
Figures 3A, 3B, 3C:
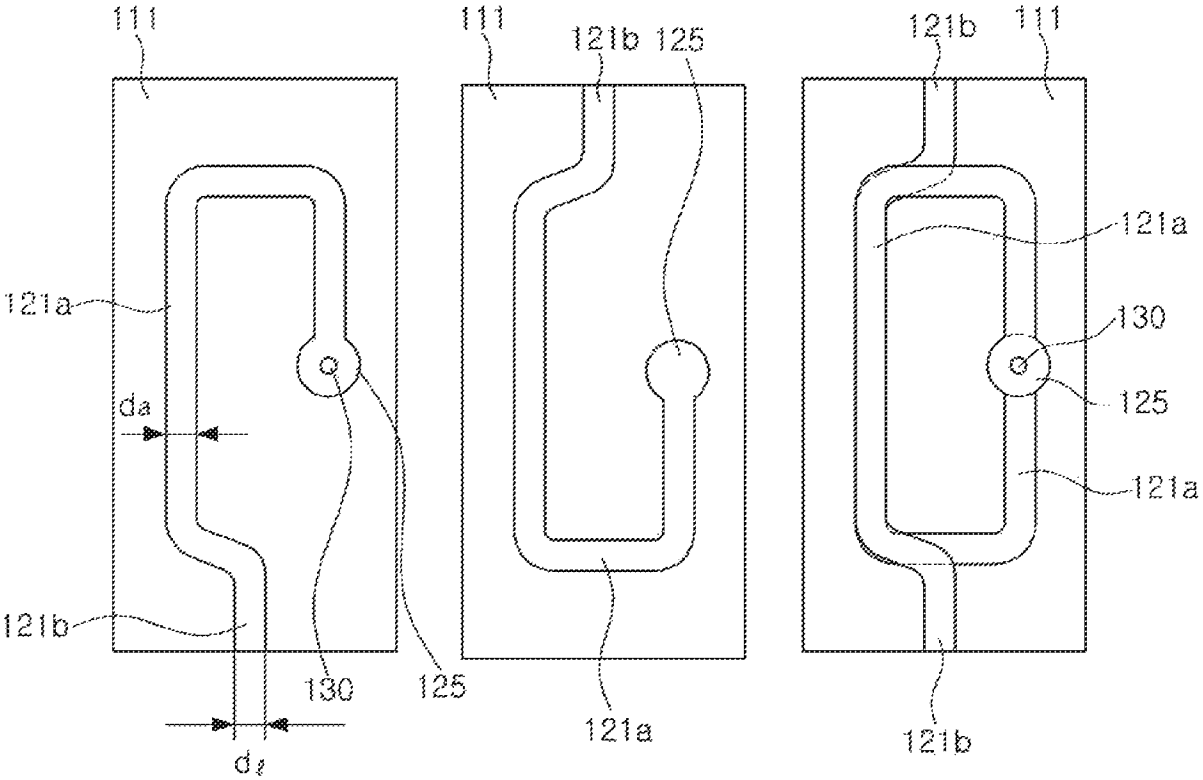
FIGS. 3A through 3C are plan views illustrating coil electrode layers constituting a coil of the multilayer chip bead according to an exemplary embodiment in the present disclosure.
Figures 4A, 4B, 4C:
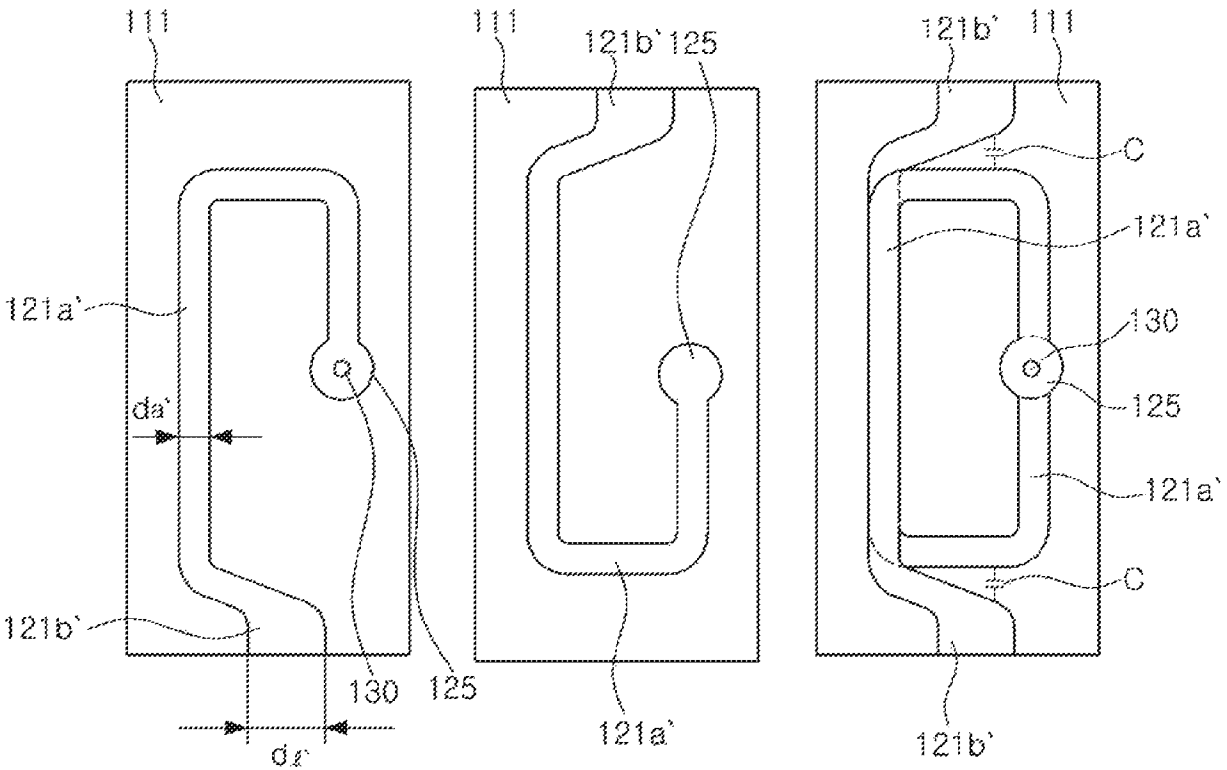
FIGS. 4A through 4C are plan views illustrating coil electrode layers constituting a coil of a multilayer chip bead according to Comparative Example.
Figure 5:
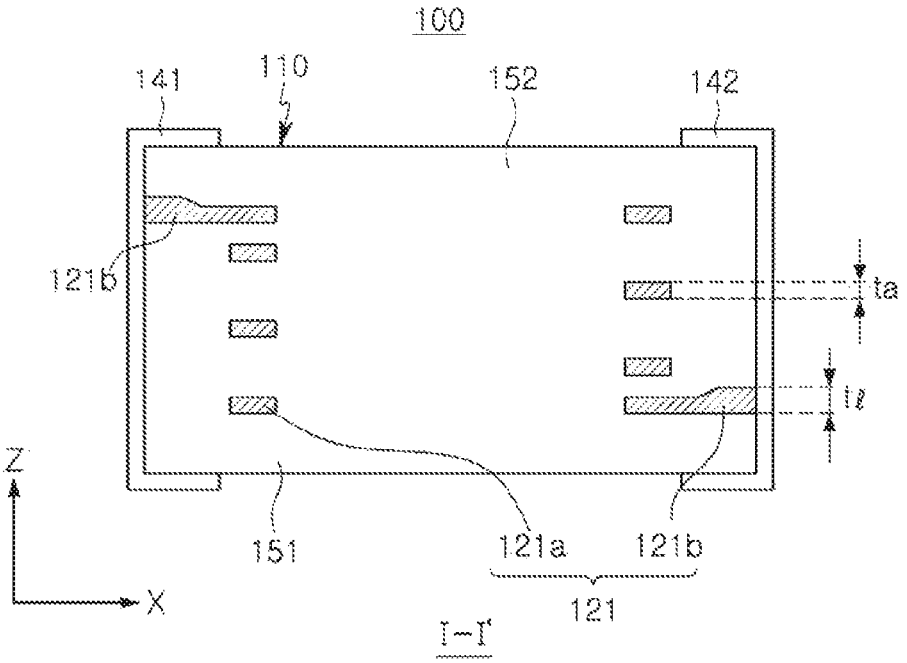
FIG. 5 is a cross-sectional view taken along line I-I' of FIG. 1.

FIG. 1 is a schematic perspective view illustrating a multilayer chip bead according to an exemplary embodiment in the present disclosure, and FIG. 2 is a schematic exploded perspective view illustrating the multilayer chip bead according to an exemplary embodiment in the present disclosure. FIGS. 3A through 3C are plan views illustrating coil electrode layers constituting a coil of the multilayer chip bead according to an exemplary embodiment in the present disclosure, and FIGS. 4A through 4C are plan views illustrating coil electrode layers constituting a coil of a multilayer chip bead according to Comparative Example. FIG. 5 is a cross-sectional view taken along line I-I' of FIG. 1.

Referring to FIGS. 1-3C and 5, the multilayer chip bead 100 according to the exemplary embodiment in the present disclosure may include a body 110 and external electrodes 141 and 142 disposed on external surfaces of the body 110.

The body 110 may be formed by stacking a plurality of magnetic layers 111 in a first direction, that is, a height direction Z. A first cover layer 151 may be disposed at a lower portion of the body 110, and a second cover layer 152 may be disposed at an upper portion of the body 110. A coil portion of the body 110 refers to a portion of the body 110 in which coil electrode layers 121 are disposed as described below.

The magnetic layer 111 may include a magnetic material such as $Fe_2O_3$, NiO, ZnO, CuO, or the like. For example, the magnetic layer 111 may include Ni—Cu—Zn based ferrite.

The external electrodes 141 and 142 may be formed by forming electrode layers on opposite end surfaces of the body 110 in a second direction X perpendicular to the first direction Z using a conductive paste, or the like, including conductive particles, and then forming plating layers on the electrode layers.

The conductive particles included in the conductive paste may be any one of metal particles having excellent conductivity, such as copper particles, nickel particles, silver particles, palladium particles, and the like, or mixtures thereof, but are not limited thereto.

For example, nickel plating layers and tin plating layers may be formed as the plating layers by electroplating or electroless plating. For example, the outermost layers of the plating layers may be the tinplating layers, and the nickel electrode layers may be disposed between the tin plating layers and the electrode layers.

The external electrodes 141 and 142 may include a first external electrode 141 and a second external electrode 142.

The first and second external electrodes 141 and 142 may be connected to both end portions of a coil to be described below, respectively.

The coil electrode layers 121 may be disposed on the magnetic layers 111.

The coil electrode layers 121 may be formed by printing a conductive paste including conductive particles having excellent conductivity, such as silver (Ag) particles, or the like, or may be formed by a method such as plating, or the like.

The coil electrode layers 121 may include coil patterns 121*a* having a spiral shape.

In addition, some of the coil electrode layers 121 may include coil patterns 121*a* having a spiral shape and lead patterns 121*b*.

The lead patterns 121*b* may be disposed at one end portions of the coil patterns 121*a* disposed on the uppermost layer and the lowermost layer, and connection patterns 125 may be disposed at the other end portions thereof.

In addition, connection patterns 125 may be disposed at both end portions of coil patterns 121*a* positioned at a middle portion.

Connection patterns 125 of adjacent coil patterns 121*a* may be connected to each other by conductive vias 130. That is, a plurality of coil electrode layers 121 may be connected to each other by the conductive vias 130 to form a coil.

The conductive vias may be formed by forming through-holes in positions of the magnetic layers 111 corresponding to the connection patterns 125 and filling a conductive material such as silver (Ag) in the through-holes.

Referring to FIGS. 3A-3C, in the multilayer chip bead 100 according to the exemplary embodiment in the present disclosure, a width $d_l$ of the lead pattern 121*b* may be smaller than a width $d_a$ of the coil pattern 121*a*.

Referring to FIGS. 4A-4C, it may be appreciated that in the multilayer chip bead according to Comparative Example, a width $d_{l'}$ of a lead pattern 121*b*' may be equal to or greater than a width $d_{a'}$ of a coil pattern 121*a*'.

FIG. 4C illustrates that coil electrode layers of FIGS. 4A and 4B overlap with each other. Referring to FIG. 4C, it may be confirmed that stray capacitance C due to parasitic capacitance is generated between the lead pattern 121*b*' and the coil pattern 121*a*'.

FIG. 3C illustrates that coil electrode layers of the multilayer chip bead 100 according to the exemplary embodiment in the present disclosure illustrated in FIGS. 3A and 3B overlap with each other. Referring to FIG. 3C, it may be confirmed that facing portions do not exist between the lead pattern 121*b* and the coil pattern 121*a*, such that stray capacitance due to parasitic capacitance between the lead pattern 121*b* and the coil pattern 121*a* does not exist or is reduced.

That is, in the multilayer chip bead 100 according to the exemplary embodiment in the present disclosure, the width $d_l$ of the lead pattern 121*b* is smaller than the width $d_a$ of the coil pattern 121*a*, such that the facing portions may not exist between the lead pattern 121*b* and the coil pattern 121*a*, resulting in reduction the stray capacitance due to the parasitic capacitance.

A ratio ($d_l/d_a$) of the width of the lead pattern 121*b* to the width of the coil pattern 121*a* may be 0.8 or more and be less than 1. When the ratio ($d_l/d_a$) of the width of the lead pattern 121*b* to the width of the coil pattern 121*a* is 1 or more, the stray capacitance may be generated between the lead pattern 121*b* and the coil pattern 121*a*, and when the ratio ($d_l/d_a$) of the width of the lead pattern 121*b* to the width of the coil pattern 121*a* is less than 0.8, connection force between the external electrodes 141 and 142 and the lead patterns 121*b* may be reduced.

Referring to FIG. 5, a thickness $t_l$ of the lead pattern 121*b* may be greater than a thickness $t_a$ of the coil pattern 121*a*.

In order to reduce the stray capacitance between the coil pattern 121*a* and the lead pattern 121*b* of the multilayer chip bead 100, the width $d_l$ of the lead pattern 121*b* needs to be smaller than the width $d_a$ of the coil pattern 121*a*. However, in this case, the connection force between the external electrodes 141 and 142 and the lead patterns 121*b* may be reduced. In addition, when the ratio of the width of the lead pattern 121*b* to the width of the coil pattern 121*a* is less than 1, Rdc may be increased.

Therefore, the thickness $t_l$ of the lead pattern 121*b* may be made to be greater than the thickness $t_a$ of the coil pattern 121*a* to reduce the stray capacitance of the multilayer chip bead, increase the connection force between the external electrodes 141 and 142 and the lead patterns 121*b*, and prevent an increase in the Rdc of the multilayer chip bead.

An aspect ratio, defined to be a ratio of the thickness to the width, of the lead pattern 121*b* may be 0.2 or more. The aspect ratio of the lead pattern 121*b* may be 0.5 or more.

When the aspect ratio of the lead pattern 121*b* is less than 0.2, the connection force between the external electrodes 141 and 142 and the lead patterns 121*b* is not sufficient, such that a connection defect may occur, and the stray capacitance due to the parasitic capacitance may be generated between the coil pattern 121*a* disposed above or below the lead pattern 121*b* and the lead pattern 121*b*.

Table 1 represents specifications of Samples in which line widths and thicknesses of lead patterns are changed, and Table 2 represents measurement results for characteristics of Comparative Example and Samples of Table 1.

TABLE 1

| | Division | Comparative Example | Sample 1 | Sample 2 | Sample 3 |
|---|---|---|---|---|---|
| Coil Pattern | Line Width (μm) | 100 | 100 | 100 | 100 |

TABLE 1-continued

| Division | | Comparative Example | Sample 1 | Sample 2 | Sample 3 |
|---|---|---|---|---|---|
| Lead Pattern | Thickness (μm) | 41 | 41 | 41 | 41 |
| | Cross-sectional Area ($\mu m^2$) | 4100 | 4100 | 4100 | 4100 |
| | Aspect Ratio | 0.41 | 0.41 | 0.41 | 0.41 |
| | Line Width (μm) | 180 | 140 | 80 | 80 |
| | Thickness (μm) | 41 | 41 | 41 | 53 |
| | Cross-sectional Area ($\mu m^2$) | 7380 | 5740 | 3280 | 4240 |
| | Aspect Ratio | 0.23 | 0.29 | 0.51 | 0.66 |
| Width of Lead Pattern/ Width of Coil Pattern | | 1.8 | 1.4 | 0.8 | 0.8 |
| Cross-sectional Area of Lead Pattern/Cross-sectional Area of Coil Pattern | | 1.80 | 1.40 | 0.80 | 1.03 |

TABLE 2

| Characteristics | Comparative Example 1 | Sample 1 | Sample 2 | Sample 3 |
|---|---|---|---|---|
| Rdc(mΩ) | 9.56 | 9.58 | 11.95 | 9.57 |
| Inductance (nH) | 107.3 | 111.5 | 112.1 | 115.6 |
| Capacitance (pF) | 0.0984 | 0.0910 | 0.0808 | 0.0805 |
| SRF (MHz) | 1549 | 1580 | 1672 | 1650 |
| Impedance @1 GHz (Ω) | 29.3 | 31.5 | 35.3 | 35.1 |

Referring to Tables 1 and 2, it may be confirmed that as the line width $d_l$ of the lead pattern 121*b* is reduced as in Samples 2 and 3, the parasitic capacitance between the coil pattern 121*a* and the lead pattern 121*b* is reduced, such that the stray capacitance is reduced. Particularly, it may be appreciated that as the parasitic capacitance is reduced, a self-resonant frequency (SFR) is increased.

However, when the line width $d_l$ of the lead pattern 121*b* is reduced simply as described above, a cross-sectional area of the lead pattern 121*b* may be reduced as in Sample 2, and the Rdc may thus be increased.

However, as in Sample 3, the thickness $t_l$ of the lead pattern 121*b* may be increased to increase a cross-sectional area of the lead pattern 121*b*, resulting in preventing an increase in the Rdc of the multilayer chip bead, and the line width $d_l$ of the lead pattern 121*b* may be reduced to reduce the stray capacitance of the multilayer chip bead. That is, in the multilayer chip bead of Sample 3, the increase in the Rdc of the multilayer chip bead may be prevented, and the stray capacitance of the multilayer chip bead may be reduced, such that the self-resonant frequency (SFR) of the multilayer chip bead may be increased.

Figure 6:
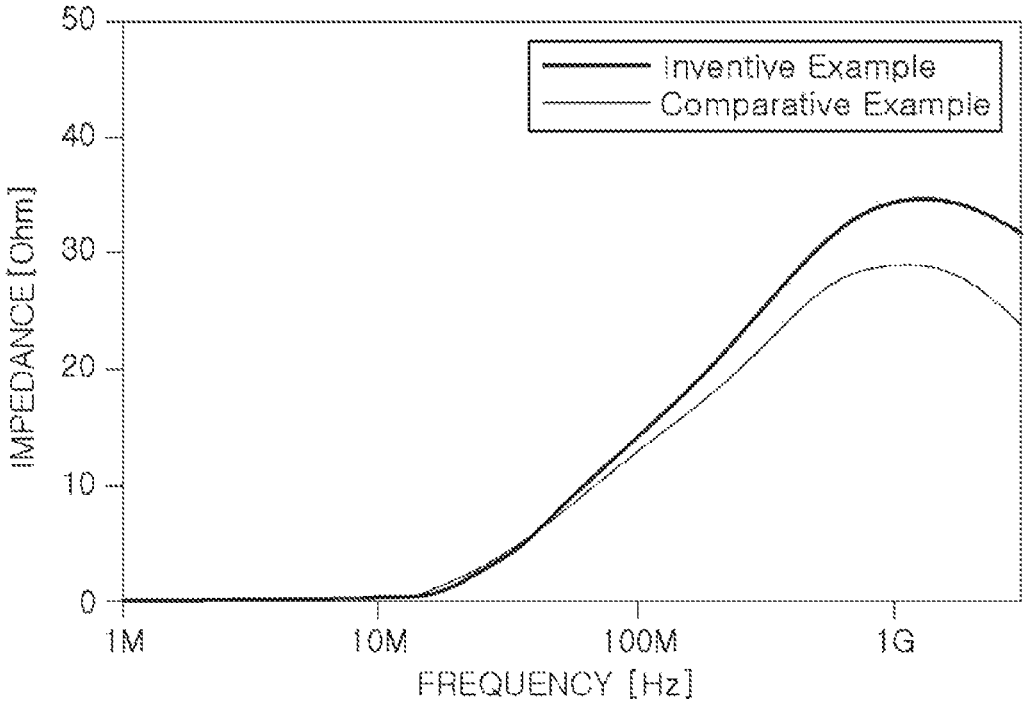
FIG. 6 is graphs illustrating measurement results of impedance changes of a multilayer chip bead according to Comparative Example and a multilayer chip bead according to Inventive Example depending on frequencies.

FIG. 6 is graphs illustrating measurement results of impedance changes of a multilayer chip bead according to Comparative Example and a multilayer chip bead according to Inventive Example depending on frequencies.

Referring to FIG. 6, it may be confirmed that since the width $d_l$ of the lead pattern 121*b* is smaller than the width $d_a$ of the coil pattern 121*a* in the multilayer chip bead 100 according to Inventive Example, the stray capacitor of the multilayer chip bead due to the parasitic capacitance is reduced, such that the self-resonant frequency (SFR) of the multilayer chip bead moves to a higher frequency region as compared to Comparative Example. Therefore, it may be confirmed that a high frequency removal region of the multilayer chip bead 100 according to Inventive Example becomes wide and capacity of the multilayer chip bead 100 according to the exemplary embodiment in the present disclosure at a high frequency is also increased, such that noise removal capability is improved.

Figure 7:
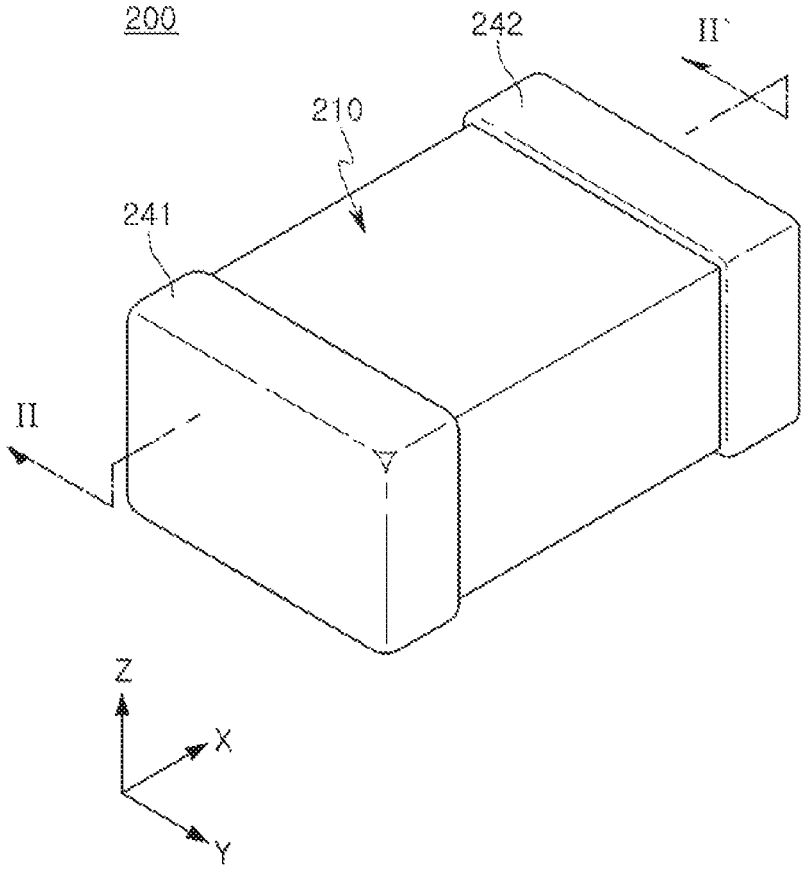
FIG. 7 is a schematic perspective view illustrating a multilayer chip bead according to another exemplary embodiment in the present disclosure.
Figure 8:
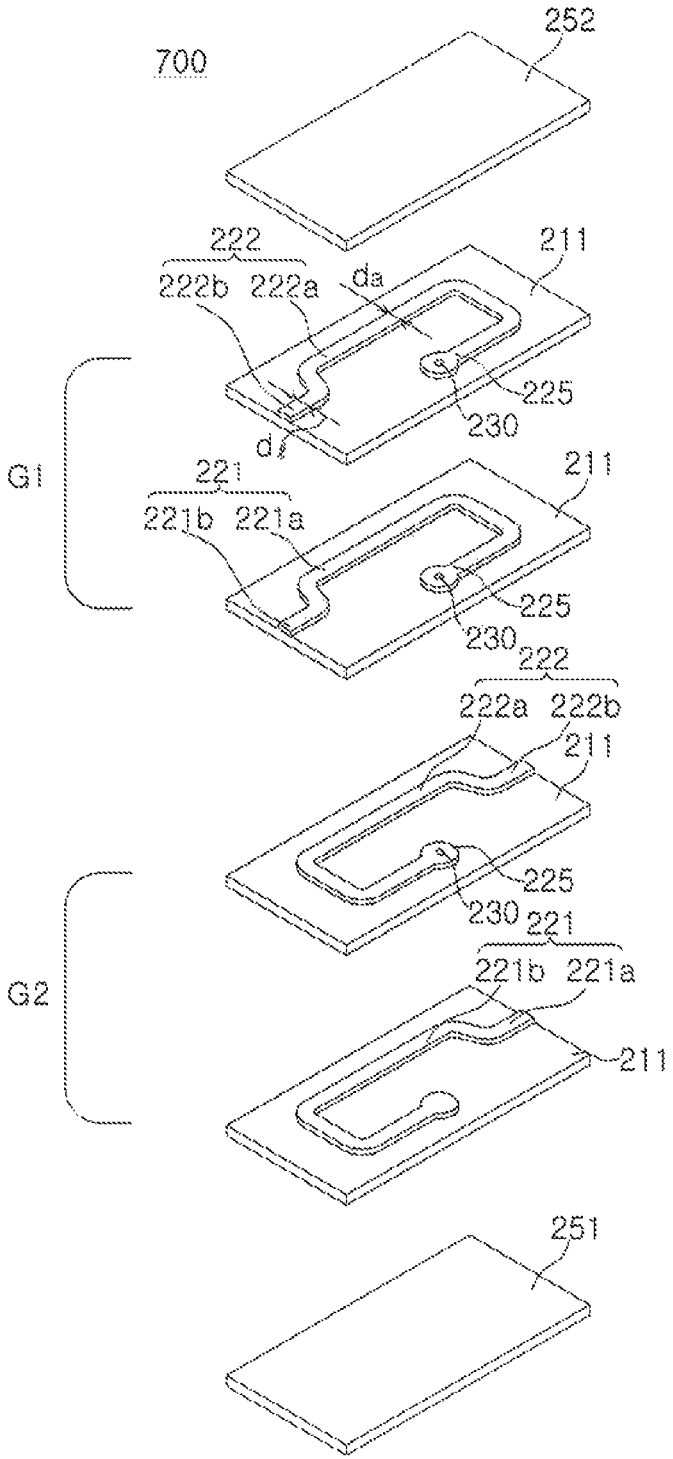
FIG. 8 is a schematic exploded perspective view illustrating the multilayer chip bead according to another exemplary embodiment in the present disclosure.
Figure 9:
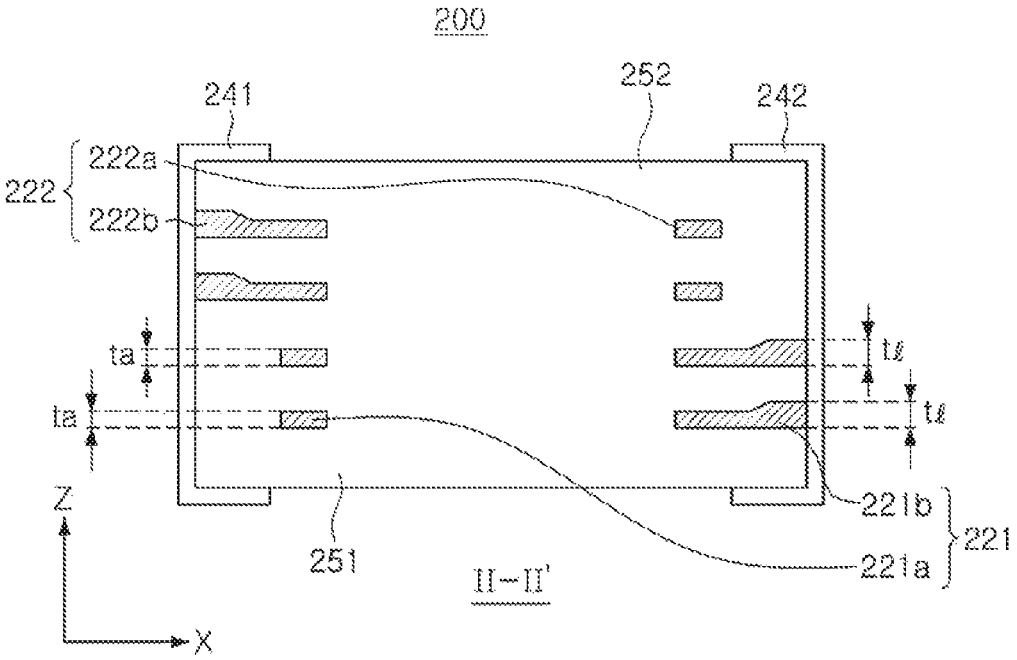
FIG. 9 is a schematic cross-sectional view taken along line II-II' of FIG. 7.

FIG. 7 is a schematic perspective view illustrating a multilayer chip bead according to another exemplary embodiment in the present disclosure, FIG. 8 is a schematic exploded perspective view illustrating the multilayer chip bead according to another exemplary embodiment in the present disclosure, and FIG. 9 is a schematic cross-sectional view taken along line II-II' of FIG. 7.

A structure of the multilayer chip bead 200 according to another exemplary embodiment in the present disclosure will be described with reference to FIGS. 7 through 9.

Referring to FIG. 7, the multilayer chip bead 200 according to another exemplary embodiment in the present disclosure may include a body 210 and external electrodes 241 and 242 disposed on external surfaces of the body 210.

The body 210 may be formed by stacking a plurality of magnetic layers 211 in a first direction, that is, a height direction Z. A first cover layer 251 may be disposed at a lower portion of the body 210, and a second cover layer 252 may be disposed at an upper portion of the body 210. A coil portion of the body 210 refers to a portion of the body 210 in which coil electrode layers 221 and 222 are disposed as described below.

The magnetic layer 211 may include a magnetic material such as $Fe_2O_3$, NiO, ZnO, CuO, or the like. For example, the magnetic layer 211 may include Ni—Cu—Zn based ferrite.

The external electrodes 241 and 242 may be formed by forming electrode layers on opposite end surfaces of the body 210 in a second direction X perpendicular to the first direction Z using a conductive paste, or the like, including conductive particles, and then forming plating layers on the electrode layers.

The conductive particles included in the conductive paste may be any one of metal particles having excellent conductivity, such as copper particles, nickel particles, silver particles, palladium particles, and the like, or mixtures thereof, but are not limited thereto.

For example, nickel plating layers and tin plating layers may be formed as the plating layers by electroplating or electroless plating. For example, the outermost layers of the plating layers may be the tinplating layers, and the nickel plating layers may be disposed between the tin plating layers and the electrode layers.

The external electrodes 241 and 242 may include a first external electrode 241 and a second external electrode 242.

The first and second external electrodes 241 and 242 may be connected to both end portions of first and second coils to be described below, respectively.

First magnetic layers of the magnetic layers 211 refer to magnetic layers on which first coil electrode layers 221 are disposed, and second magnetic layers of the magnetic layers 211 refer to magnetic layers on which second coil electrode layers 222 are disposed. That is, the first coil electrode layers 221 may be disposed on the first magnetic layers, and the second coil electrode layers 222 may be disposed on the second magnetic layers.

The coil electrode layers 221 and 222 may be formed by printing a conductive paste including conductive particles having excellent conductivity, such as silver (Ag) particles, or the like, or may be formed by a method such as plating, or the like.

The first coil electrode layers 221 may include first coil patterns 221*a* having a spiral shape and first lead patterns 221*b*, and the second coil electrode layers 222 may include second coil patterns 222*a* having a spiral shape and second lead patterns 222*b*.

The first coil electrode layers 221 may be connected to the first and second external electrodes 241 and 242 through the first lead patterns 221*b*, and the second coil electrode layers 222 may be connected to the first and second external electrodes 241 and 242 through the second lead patterns 222*b*.

The first lead patterns 221*b* may be disposed at one end portions of the first coil patterns 221*a*, and connection patterns 225 may be disposed at the other end portions thereof. Connection patterns 225 of adjacent first coil patterns 221*a* may be connected to each other by conductive vias 230. That is, a plurality of first coil electrode layers 221 may be connected to each other by the conductive vias 230 to form a first coil having a spiral shape.

The second lead patterns 222*b* may be disposed at one end portions of the second coil patterns 222*a*, and connection patterns 225 may be disposed at the other end portions thereof. Connection patterns 225 of adjacent second coil patterns 222*a* may be connected to each other by conductive vias 230. That is, a plurality of second coil electrode layers 222 may be connected to each other by the conductive vias 230 to form a second coil having a spiral shape.

The conductive vias 230 may be formed by forming through-holes in positions of the magnetic layers 211 corresponding to the connection patterns 225 and filling a conductive material such as silver (Ag) in the through-holes.

Both end portions of the first coil may be connected to the first and second external electrodes 241 and 242, respectively, and both end portions of the second coil may also be connected to the first and second external electrodes 241 and 242, respectively.

That is, the first and second coils may be connected to the first and second external electrodes 241 and 242 in parallel.

The coil portion may include a plurality of coil groups G1 and G2.

One coil group may include the first and second coil electrode layers 221 and 222.

Referring to FIG. 8, shapes of the first and second coil electrode layers 221 and 222 included in the same coil group may be the same as each other.

The plurality of coil groups G1 and G2 may include a first coil group G1 and a second coil group G2.

Referring to FIG. 8, in the multilayer chip bead 200 according to another exemplary embodiment in the present disclosure, a width $d_l$ of each of the first and second lead patterns 221*b* and 222*b* may be smaller than a width $d_a$ of each of the first and second coil patterns 221*a* and 222*a*.

In the multilayer chip bead 200 according to another exemplary embodiment in the present disclosure, the width $d_l$ of each of the first and second lead patterns 221*b* and 222*b* is smaller than the width $d_a$ of each of the first and second coil patterns 221*a* and 222*a*, such that facing portions may not exist between the first and second lead patterns 221*b* and 222*b* and the first and second coil patterns 221*a* and 222*a*, resulting in reduction stray capacitance C due to parasitic capacitance.

A ratio ($d_l/d_a$) of the width of each of the first and second lead patterns 221*b* and 222*b* to the width of each of the first and second coil patterns 221*a* and 222*a* may be 0.8 or more and be less than 1. When the ratio ($d_l/d_a$) of the width of each of the first and second lead patterns 221*b* and 222*b* to the width of each of the first and second coil patterns 221*a* and 222*a* is 1 or more, the stray capacitance may be generated between the first and second lead patterns 221*b* and 222*b* and the first and second coil patterns 221*a* and 222*a*, and when the ratio ($d_l/d_a$) of the width of each of the first and second lead patterns 221*b* and 222*b* to the width of each of the first and second coil patterns 221*a* and 222*a* is less than 0.8, connection force between the external electrodes 141 and 142 and the first and second lead patterns 221*b* and 222*b* may be reduced.

Referring to FIG. 9, a thickness $t_l$ of each of the first and second lead patterns 221*b* and 222*b* may be greater than a thickness $t_a$ of each of the first and second coil patterns 221*a* and 222*a*.

In order to reduce the stray capacitance between the first and second coil patterns 221*a* and 222*a* and the first and second lead patterns 221*b* and 222*b* of the multilayer chip bead 200, the width $d_l$ of each of the first and second lead patterns 221*b* and 222*b* needs to be smaller than the width $d_a$ of each of the first and second coil patterns 221*a* and 222*a*. However, in this case, the connection force between the external electrodes 241 and 242 and the first and second lead patterns 221*b* and 222*b* may be reduced.

Therefore, the thickness $t_l$ of each of the first and second lead patterns 221*b* and 222*b* may be made to be greater than the thickness $t_a$ of each of the first and second coil patterns 221*a* and 222*a* to reduce the stray capacitance of the multilayer chip bead and increase the connection force between the external electrodes 241 and 242 and the first and second lead patterns 221*b* and 222*b*.

An aspect ratio, defined to be a ratio of the thickness of each of the first and second lead patterns 221*b* and 222*b* to the width of each of the first and second lead patterns 221*b* and 222*b*, may be 0.2 or more. The aspect ratio of each of the first and second lead patterns 221*b* and 222*b* may be 0.5 or more.

When the aspect ratio of each of the first and second lead patterns 221*b* and 222*b* is less than 0.2, the connection force between the external electrodes 241 and 242 and the first and second lead patterns 221*b* and 222*b* is not sufficient, such that a connection defect may occur, and the stray capacitance due to the parasitic capacitance may be generated between the first and second coil patterns 221*a* and 222*a* disposed above or below the first and second lead patterns 221*b* and 222*b* and the first and second lead patterns 221*b* and 222*b*.

As set forth above, in the multilayer chip bead according to the exemplary embodiment in the present disclosure, the width of the lead pattern is smaller than that of the coil pattern, such that the stray capacitance between the lead pattern and the coil pattern may be reduced.

In addition, in the multilayer chip bead according to the exemplary embodiment in the present disclosure, the cross-sectional view of the lead pattern is made to be the same as or greater than that of the coil pattern, such that the increase in the Rdc generated when the width of the lead pattern is smaller than that of the coil pattern may be prevented.

In addition, the stray capacitance of the multilayer chip bead according to the exemplary embodiment in the present disclosure may be reduced, such that noise removal capability at a high frequency may be improved.

While exemplary embodiments have been shown and described above, it will be apparent to those skilled in the art that modifications and variations could be made without departing from the scope of the present invention as defined by the appended claims.

What is claimed is:

1. A multilayer chip bead comprising:

a body including a coil portion and cover layers disposed on upper and lower surfaces of the coil portion;

a coil disposed in the coil portion, the coil including coil patterns having a spiral shape and first and second lead patterns, the coil patterns being disposed on magnetic layers, respectively, and the magnetic layers being stacked in a stacking direction; and first and second external electrodes respectively disposed on external surfaces of the body opposing each other in a length direction perpendicular to the stacking direction, wherein the first and second lead patterns extend in the length direction, and are exposed from the external surfaces, respectively, the coil patterns include a first coil pattern disposed on a first magnetic layer of the magnetic layers, on which the first lead portion is disposed, the first coil pattern includes one section extending in the length direction, and an end of the one section of the first coil pattern is connected to the first lead portion by a first curved coil pattern on the first magnetic layer, the coil patterns include a second coil pattern disposed on a second magnetic layer of the magnetic layers, on which the second lead portion is disposed, the second coil pattern includes one section extending in the length direction, and an end of the one section of the second coil pattern is connected to the second lead portion by a second curved coil pattern on the second magnetic layer, and a width of each of the first and second lead patterns is smaller than that of each of the coil patterns.

2. The multilayer chip bead of claim 1, wherein a ratio of the width of each of the first and second lead patterns to the width of each of the coil patterns is in a range of 0.8 to 1, inclusive.

3. The multilayer chip bead of claim 1, wherein a ratio of a cross-sectional area of each of the first and second lead patterns to a cross-sectional area of each of the coil patterns is 1.0 or more.

4. The multilayer chip bead of claim 1, wherein a thickness of each of the first and second lead patterns is greater than that of each of the coil patterns.

5. The multilayer chip bead of claim 1, wherein a cross-sectional area of each of the first and second lead patterns is greater than that of each of the coil patterns.

6. The multilayer chip bead of claim 1, wherein an aspect ratio of a thickness of each of the first and second lead patterns to the width of each of the lead patterns is 0.2 or more.

7. The multilayer chip bead of claim 1, wherein the body includes Ni—Cu—Zn based ferrite.

* * * * *